United States Patent [19]

Vicard

[11] 4,263,861

[45] Apr. 28, 1981

[54] SAILING CRAFT

[76] Inventor: Pierre G. Vicard, 15 Cours Eugenie, 69003 Lyons, France

[21] Appl. No.: 950,099

[22] Filed: Oct. 10, 1978

[30] Foreign Application Priority Data

Oct. 10, 1977 [FR] France ..... 77 31104

[51] Int. Cl.[3] ..... B63B 35/00; B63H 9/00

[52] U.S. Cl. ..... 114/39; 114/90; 114/95; 114/103; 114/114

[58] Field of Search ..... 114/90, 95, 96, 102, 114/103, 114, 30, 104, 105

[56] References Cited

U.S. PATENT DOCUMENTS

| | | | |
|---|---|---|---|
| 3,132,620 | 5/1964 | Court | 114/39 |
| 3,298,346 | 1/1967 | Cochran | 114/103 |
| 3,391,668 | 7/1968 | Birchill | 114/103 |
| 3,795,216 | 3/1974 | MacPherson | 114/103 X |
| 3,867,894 | 2/1975 | Vicard | 114/102 |
| 3,948,200 | 4/1976 | Hood et al. | 114/105 |
| 4,064,821 | 12/1977 | Roberts, Jr. et al. | 114/39 X |

FOREIGN PATENT DOCUMENTS

| | | | |
|---|---|---|---|
| 445639 | 4/1926 | Fed. Rep. of Germany . | |
| 463701 | 7/1928 | Fed. Rep. of Germany . | |
| 1464877 | 11/1965 | France . | |
| 2240144 | 8/1973 | France . | |
| 2314863 | 6/1975 | France . | |
| 2329507 | 5/1977 | France | 114/90 |
| 1153056 | 10/1966 | United Kingdom . | |
| 1117529 | 6/1968 | United Kingdom | 114/102 |

*Primary Examiner*—Trygve M. Blix
*Assistant Examiner*—D. W. Keen
*Attorney, Agent, or Firm*—Dowell & Dowell

[57] ABSTRACT

In a sailing craft, in which the foot of a sail is attached to a yard pivoted on a boom, itself pivoted on the mast, this sail, provided to be of single or double-thickness, preferably comprising a sectioned front edge, restraints are provided for selectively blocking either the yard with respect to the boom, or the boom with respect to the hull of the craft, so that the sail may pivot either on itself or about the mast, as desired.

6 Claims, 9 Drawing Figures

SAILING CRAFT

The present invention relates generally to craft driven by means of sails and more particularly to sailing boats or sail-driven yachts. In this type of craft, the lower edge or foot of the sail (or of each sail) is attached to a rigid boom pivotally connected to the mast. It has also been proposed to attach the foot to a yard itself pivotally connected to the boom at an intermediate point of its length.

In accordance with the present invention, means are further provided for selectively blocking either the yard with respect to the boom, or the boom with respect to the hull of the craft, so that the sail may pivot either on itself or about the mast, as desired.

The invention will be more readily understood on reading the following description with reference to the accompanying drawings in which.

Figure 1:
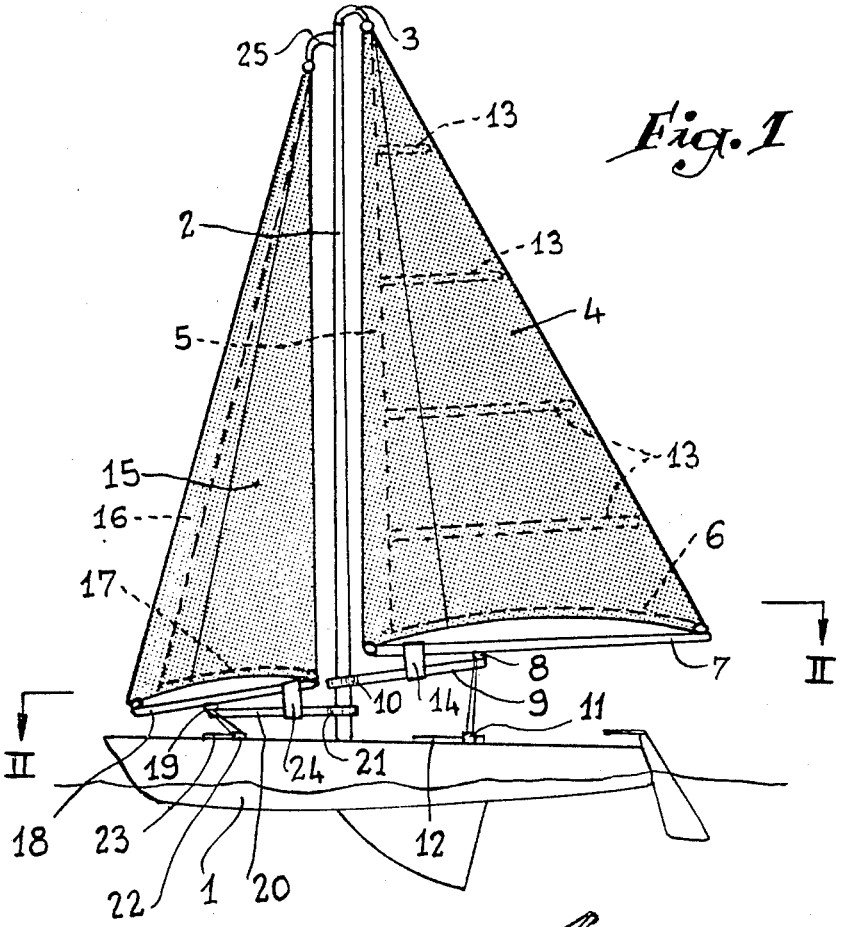
FIG. 1 is a view in elevation of a first embodiment of a sailing boat according to the invention.
Figure 2:
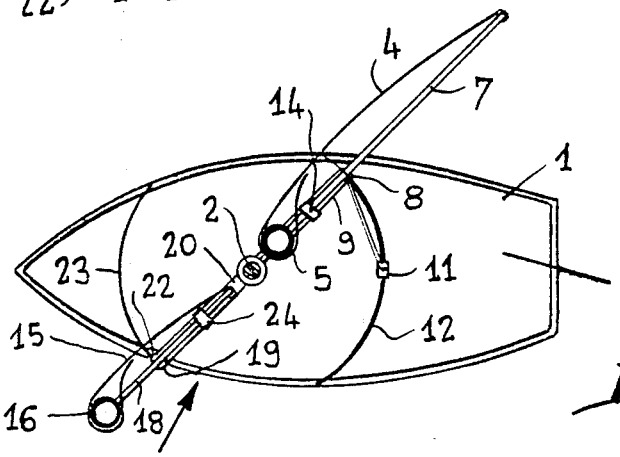
FIG. 2 is a section along II—II (FIG. 1).

Referring now to the drawings, the sailing boat of FIGS. 1 and 2 comprises a hull 1 supporting a conical tubular mast 2 with an upper end 3 bent rearwardly in swan neck fashion. A halyard passes inside the mast, to which is attached the top of a mainsail 4 of which the front vertical edge is fixed to a rope 5 independent of the mast 2. The lower edge or foot of the sail comprises a rope 6 of which the ends are fixed to a yard 7 pivoted at a point of its length (about one third thereof from the front) on a boom 9 which is in turn pivoted on the mast 2 at 10. The rear end of the boom 9 is held in any suitable manner, for example by being attached to a carriage 11 fixed in position on a tiller 12. The sail 4 is stiffened by a series of horizontal slats 13.

The rope 5 is composed of a very large flexible pipe of conical longitudinal section, which is strongly inflated, on which the front part of the sail 4 (here made in single-thickness) is folded so as to produce an aerodynamic section avoiding harmful turbulences.

The lower rope 6 and the slats 16 are advantageously in the form of strongly inflated pipes (but of smaller diameter than the rope 5), which reinforces them and dampens the vibrations under the effect of the wind.

14 denotes a fastening device connecting the yard 7 to the boom 9 at a sufficient distance from the pivoting point 8 to ensure a substantially rigid connection. The fastening device 14 may be constituted by a metal stirrup member overlapping the two pieces and tightened thereon. Under these conditions, the sail 4 may be oriented about the mast 2 by displacement of the boom 9 with the aid of the carriage 11. The rope 5 is then just behind the mast 2, but due to its large diameter, this is not a drawback. Everything occurs as in the case of an aircraft wing comprising a slot at the front.

If the fastening device 14 is removed and the carriage 11 is maintained fixed, the sail 4 may then be oriented by pivoting on itself, i.e. about an axis passing through point 8 and through the end of the swan neck 3.

In the example shown in FIGS. 1 and 2, the jib 15 is arranged, like the mainsail 4, with a rope 16 composed of a large inflated pipe and a lower rope 17, preferably also composed of an inflated pipe, but of a smaller diameter. This rope 17 is attached by its ends to a yard 18 pivoted at 19 on a boom 20, itself pivoted on the mast 4 at 21. A carriage 22 movable on a tiller 23 enables the boom 20 to be oriented and a fastening device 24 may block the yard 18 on this boom.

25 denotes an auxiliary swan neck to which the top of the jib 15 is attached.

In FIG. 2, the jib 15 and the mainsail 4 are disposed in line with each other, thus forming an assembly comparable with the slotted wing of an aircraft, the mast 2 being lodged in the slot in question.

Figure 3:
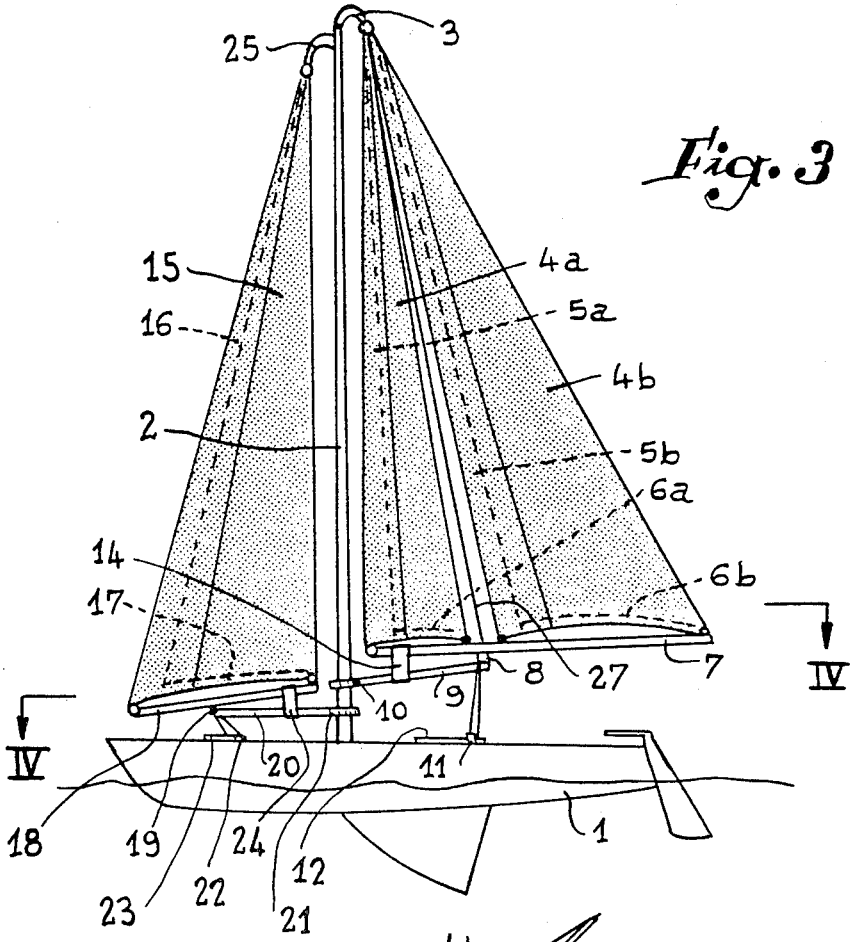
FIG. 3 shows a variant sail divided into two elements with intermediate slit.
Figure 4:
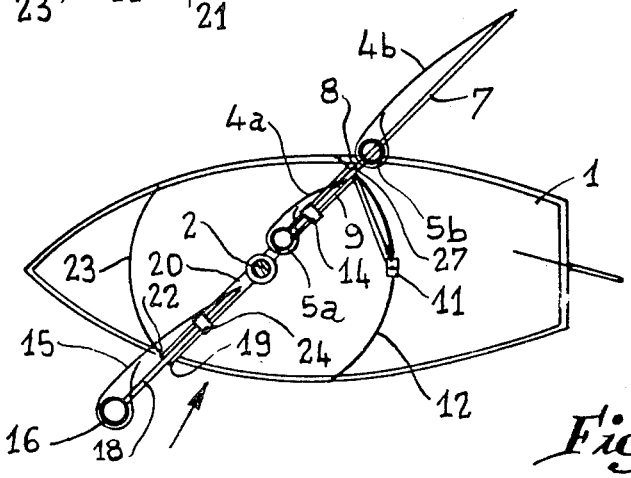
FIG. 4 is a section along IV—IV (FIG. 3).

FIGS. 3 and 4 show an arrangement in which the mainsail is divided into two elementary parts or sails 4*a*, 4*b* to make, independently of the jib, a section in the form of the slotted wing of an aircraft. The front part 4*a* is folded around a front rope 5*a*, the rear part 4*b* around another rope 5*b*. The lower ropes 6*a*, 6*b* of the two parts are attached to the same yard 7 pivoted at 8 on the boom 9. There again, the ropes are composed of inflated flexible pipes, 5*a* and 5*b* being of very large diameter.

A stay such as 27 is preferably housed in the slot provided between the two elementary parts or sails 4*a*, 4*b*.

Figure 5:
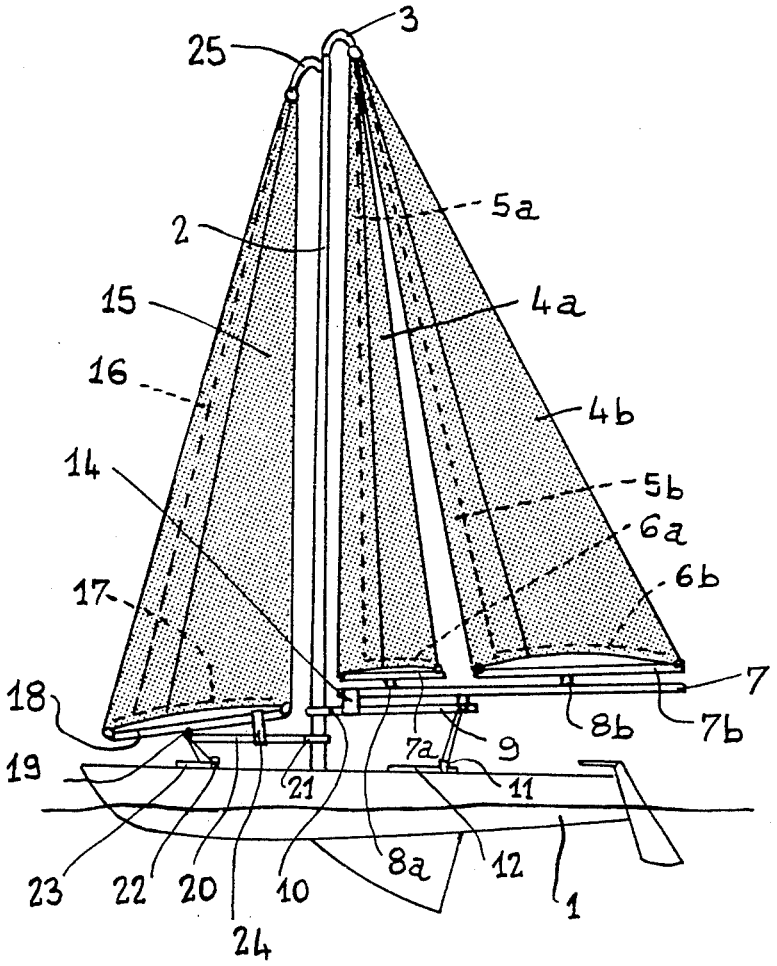
FIG. 5 shows a modification of the arrangement according to FIG. 3.

In the variant embodiment of FIG. 5, each of the two elementary sails 4*a*, 4*b* is attached to an individual elementary lower yard 7*a*, 7*b*, respectively, and these two yards are respectively pivoted at 8*a*, 8*b* on the common yard 7, itself pivoted on the boom 9. Fastening devices (not shown) may advantageously be provided between the elementary yards 7*a*, 7*b* and the common yard 7, this multiplying the possibilities of orientation.

Figure 6:
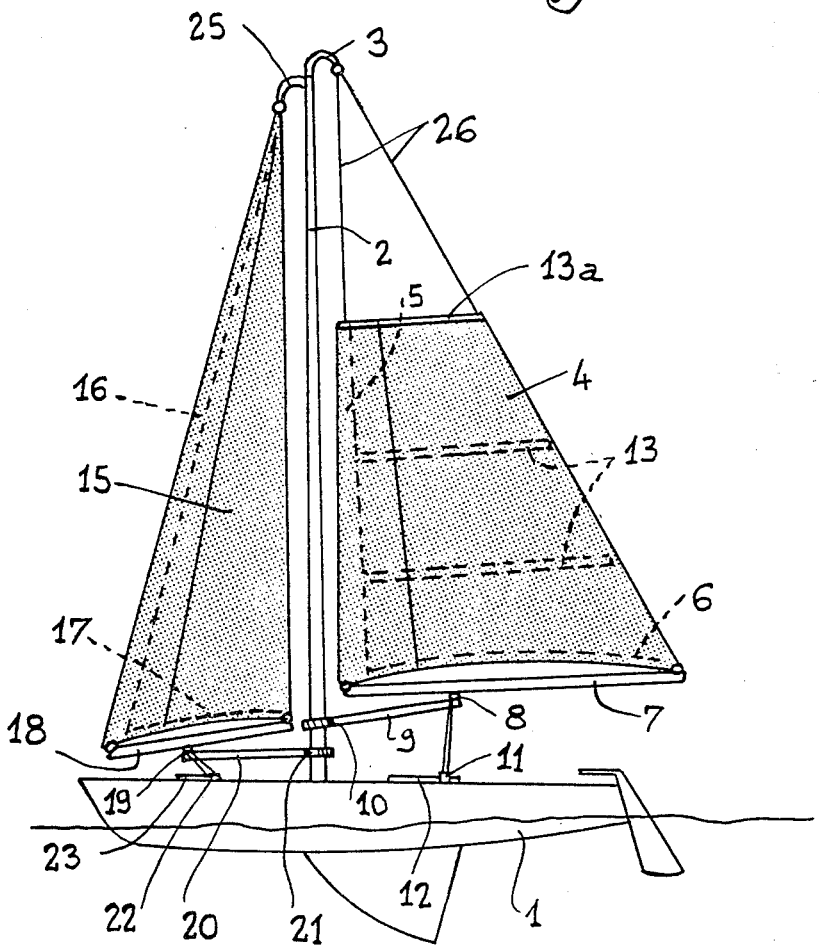
FIG. 6 shows a variant sail not extending to the top of the mast.

In FIG. 6, the mainsail 4, made in one piece as in FIGS. 1 and 2, stops at the level of the upper slat referenced 13*a*, which is provided to act as rope, its ends being connected to the swan neck 3 by two stays 26. This arrangement enables the surface of the sails to be reduced when desired.

Figure 9:
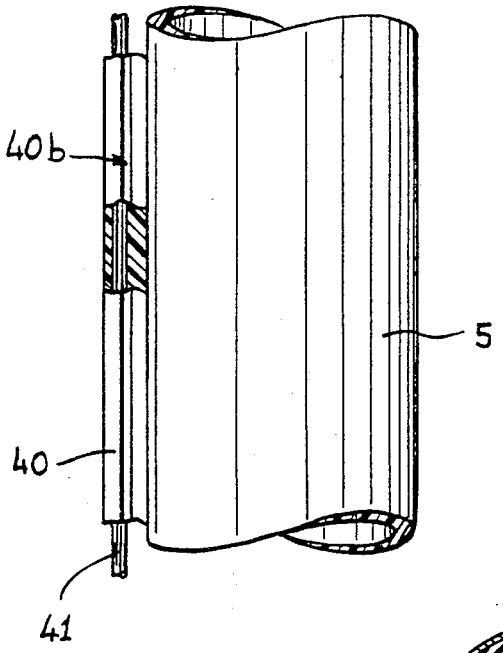
FIG. 9 is a part elevational view of the rope of FIGS. 7 and 8, the sail being assumed to have been removed.
Figure 8:
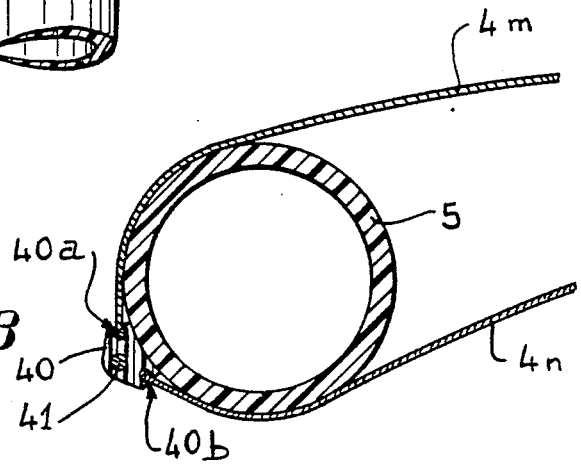
FIGS. 7 and 8 show in section a rope of large diameter on which are wound the two elementary sail-cloths of a double-thickness sail, the opposite edges being connected by a sliding element.
Figure 7:
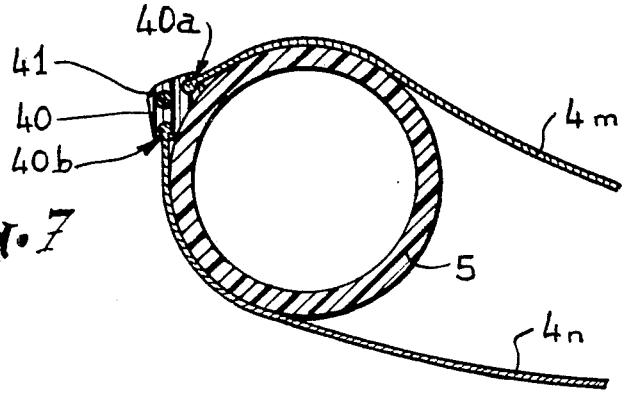

In FIGS. 7 to 9, it has been assumed that the sail was made in known manner of two sailcloths forming therebetween an inner, possibly inflated space so that the assembly produces an aerodynamic section similar to that of an aircraft wing. The two elementary sailcloths 4*m* and 4*n* are thus wound by a certain angle around a front rope 5 made in the form of a fairly strongly inflated pipe of large diameter. However, their opposite edges are not directly connected to each other. An elementary element 40 is, on the contrary, provided over the height of the rope 5, which comprises two opposite vertical notches 40*a*, 40*b* in which are slidably engaged the opposite edges of the sailcloths 4*m*, 4*n*, these edges being given additional thickness in manner known per se. Furthermore, the central part of the element 40 is perforated for the passage of an auxiliary rope 41.

A comparison of FIGS. 7 and 8 clearly shows that, due to this arrangement, the sail assembly 4*m*, 4*n* may slide by rotating on the rope 5, displacing the element 40 until the tensions of the two sails are balanced. This has two consequences:

1. As the sail must be able to be used with incurvation on one side or the other, it must necessarily be symmetrical, i.e. the two sailcloths 4m, 4n must be of equal length. When the wind is blowing to port or starboard and the sail is incurved, the under and upper parts of the sailcloths are no longer of equal length and they have different tensions. Due to the freedom of slide of the element 40 on the rope 5, this difference disappears and the aerodynamic section may be conserved without inflation or exaggerated contraction.

2. When the sail is oriented, it rotates about the rope and consequently one sailcloth winds whilst the other unwinds, this again provoking a difference in tension. The free slide of the element 40 enables it to be compensated.

Of course, frictions tend to brake the element 40 on the rope 5, but due to the inevitable vibrations, this effect is negligible. The auxiliary rope 41 also tends to retain the element 40, but if its ends are very close to those of the main rope, this is not substantial.

The element 40 may be made in one piece or of a plurality of successive parts fitting on one another on the auxiliary rope 41. The edges of the two sailcloths 4m, 4n must be able to slide freely in the notches 40a, 40b so that they may be hoisted or lowered with the aid of a two-armed halyard.

What is claimed is:

1. In a sailing craft having a hull and having a mast supporting a boom and having a double sail including a foot portion attached to a yard pivotally supported by the boom and including a top portion supported and extending toward the head of the mast, the improvements comprising:

(a) a sail supporting bolt rope fixed to the forward end of the yard and supported upright by the mast;

(b) the sail having separate sailcloths joined at their trailing edge portions, and the leading edge portion of each sail cloth being bent partway around the bolt rope and approaching each other in the vicinity of the leading surface of the bolt rope, and the leading edge portion of each sailcloth having a thickened edge;

(c) a strip element having adjacent longitudinal notches shaped to slidingly receive and retain said thickened sail edges, the strip element removably joining the leading edge portions of the sail cloth and lying against the leading edge of the bolt rope and comprising the only element joining the leading edge portions of the sailcloths;

(d) the diameter of the bolt rope being sufficiently large to separate the leading portions of the sailcloth to provide the sail with an airfoil cross-section as viewed in a horizontal plane, and the width and thickness of the strip element being much smaller than the diameter of the bolt rope, whereby as the strip element shifts about the bolt rope with different wind directions it always remains within the leading surface of the bolt rope; and (e) the sail and strip element being freely rotatable about the bolt rope so that differences in tension in the two sailcloths due to changes in relative wind direction are equalized.

2. The craft as claimed in claim 1, wherein the strip element has an auxiliary rope extending longitudinally therethrough between said notches, the auxiliary rope supporting the strip element vertically of the bolt rope.

3. The craft as claimed in claim 1, wherein the bolt rope comprises a length of inflated pipe.

4. The craft as claimed in claim 1, further comprising separately controllable means for selectively controlling the position of the boom with respect to the hull, and the position of the yard with respect to the boom.

5. The craft as claimed in claim 1, wherein plural double sails are attached to plural yards and have their leading edge portions supported on plural bolt ropes, the yards being supported at plural pivotal points spaced along the boom.

6. The craft as claimed in claim 1, wherein the upper edge of the sail terminates partway up the mast and is supported by a substantially horizontal support member, the support member being supported on stays from the head of the mast.

* * * * *